US005261318A

United States Patent [19]

Allart

[11] Patent Number: 5,261,318

[45] Date of Patent: Nov. 16, 1993

[54] PRESSURE FLUID MECHANISM PROVIDED WITH SPECIAL BALANCING ENCLOSURES

[75] Inventor: Bernard R. Allart, Crepy en Valois, France

[73] Assignee: Poclain Hydraulics, Verberie Cedex, France

[21] Appl. No.: 924,317

[22] Filed: Aug. 3, 1992

[30] Foreign Application Priority Data

Aug. 1, 1991 [FR] France ..... 91 09817

[51] Int. Cl.[5] ..... F03C 1/24

[52] U.S. Cl. ..... 91/491; 91/497

[58] Field of Search ..... 91/491, 497

[56] References Cited

U.S. PATENT DOCUMENTS 3,280,757 10/1966 Eickmann .

4,724,742 2/1988 Bigo et al. ..... 91/491

FOREIGN PATENT DOCUMENTS 0223656 5/1987 European Pat. Off. .

263218 4/1988 European Pat. Off. .

2335976 1/1975 Fed. Rep. of Germany ..... 91/491

2587761 3/1987 France .

2606092 5/1988 France .

*Primary Examiner*—Richard E. Gluck

[57] ABSTRACT

The invention relates to a mechanism comprising: a cam; cylinders; pistons; two main enclosures containing feed fluid and exhaust fluid; a fluid distributor; and balancing enclosures communicating with distribution ducts included in the distributor. According to the invention, the distributor includes a face facing a reaction face secured to the cam or to the cylinder block, the balancing enclosures being constituted by chambers that open out into said end face and by a sealing device received inside the chamber and bearing against the reaction face. One application lies in providing a range of compact motors.

13 Claims, 13 Drawing Sheets

PRESSURE FLUID MECHANISM PROVIDED WITH SPECIAL BALANCING ENCLOSURES

FIELD OF THE INVENTION

The invention stems from the design of a novel hydraulic motor, but it relates more generally to a novel pressure fluid mechanism such as a hydraulic motor or a hydraulic pump, comprising: a reaction cam; a cylinder block mounted to rotate relative to said reaction cam about an axis of rotation and provided with a plane communication face perpendicular to said axis of rotation; a plurality of cylinders formed in the cylinder block; a plurality of pistons slidably mounted in said cylinders, at least one piston per cylinder and delimiting within each cylinder a fluid working chamber which communicates with said communication face via a cylinder duct; at least two main fluid enclosures suitable for containing a feed fluid for the working chambers and an exhaust fluid from said working chambers; an internal fluid distributor which is prevented from rotating about said axis of rotation relative to said reaction cam, and including a distribution face which is plane, perpendicular to said axis of rotation, and suitable for bearing in substantially fluid-tight manner against said communication face, and into which there open out distribution ducts suitable for being connected, some to one of said main enclosures and the others to the other one of said main enclosures; and balancing enclosures of the internal fluid distributor each communicating with some of said distribution ducts.

BACKGROUND OF THE INVENTION

More particularly, the original object of the invention was to design a mechanism further capable of having two distinct operating modes, one corresponding to all of the fluid working chambers being fed periodically with fluid under pressure, and the other corresponding to fluid being fed only to those working chambers that belong to a first group of fluid working chambers, with the other fluid working chambers no longer being fed with fluid under pressure in other words the mechanism was to have at least two distinct operating cylinder capacities. In a known technique for providing such a mechanism, it is necessary to provide at least three, and sometimes four distinct main enclosures, and it is necessary to provide balancing between the pressure forces that tend to separate the distribution face of the internal fluid distributor from the cylinder block communication face, enclosure by enclosure. These enclosures, of which there are at least three, follow one another axially at the periphery of the internal fluid distributor, being separated from one another by sealing gaskets, such that the axial length of the internal fluid distributor is relatively long, and it is desirable for said length to be reduced. One solution that has been proposed consists in replacing at least one and sometimes two main enclosures by one or two secondary enclosures that are no longer placed at the periphery, but inside the internal fluid distributor, which for a mechanism including four enclosures, corresponds to an axial extent that corresponds to an axial succession of only two main enclosures.

In that novel scheme, although the pressure forces corresponding to the fluid contained in the distribution ducts communicating with said two main enclosures can be balanced, in a manner known per se, by a judicious selection of shapes for the walls delimiting said main enclosures, it has been observed that the pressure forces relating to the fluid contained in the distribution ducts communicating with the internal secondary closure(s) cannot be balanced by selecting the shapes of the walls delimiting said internal secondary enclosure(s) which are, in fact, constituted by at least some of the distribution ducts themselves.

A first object of the invention is therefore to solve this problem of balancing the pressure forces of the fluid contained in the internal secondary enclosure(s) of such a mechanism having two distinct operating cylinder capacities, however, the object of the invention is wider than that and is not limited merely to implementing such mechanisms having a plurality of operating cylinder capacities. The invention is also advantageous for a mechanism having only one operating cylinder capacity. Thus, although in the first case of a mechanism having two operating cylindrical capacities, the actual length of the internal distributor can be considerably reduced, thereby making it possible to improve the mobility of said internal distributor which is less constrained by the various radial bearing surfaces delimiting the main enclosures, and thus making it possible, essentially, to improve contact sealing between the distribution face and the communication face of said mechanism, it has also been observed that it is possible to provide a mechanism having only one operating cylinder capacity even when the cam is secured to a structure identical to that of the mechanism having at least two operating cylinder capacities. This structure secured to the cam is a large and expensive part of the mechanism, and clearly it is advantageous for it to be common to the mechanisms of a manufacturing range including both mechanisms having a plurality of operating cylinder capacities and mechanisms having single operating cylinder capacities. By using a single structure secured to the cam, pressure forces are indeed balanced both in mechanisms having a plurality of operating cylinder capacities and in mechanisms having single operating cylinder capacities.

The ambit of the invention is therefore not limited to mechanisms having two operating cylinder capacities.

SUMMARY OF THE INVENTION

According to the invention, in a mechanism as defined above, the internal fluid distributor is delimited opposite from said distribution face by a transverse end face which is disposed facing a reaction face belonging to one of the two parts constituted by the cylinder block and by a structure secured to the reaction cam, while at least one of said balancing enclosures is constituted by a chamber formed in the internal fluid distributor and opening out into said transverse end face and by a sealing device which is received partially inside said chamber and which bears for reaction purposes against said reaction face.

The following advantageous dispositions are also preferably adopted:

said balancing enclosure comprises an annular groove having cylindrical walls with axes parallel to said axis of rotation;

the chamber of said balancing enclosure is a blind chamber and is connected in parallel with some of said distribution ducts, communicating with them only, without conveying the flow of fluid that may be conveyed by said distribution ducts;

said reaction face is plane and perpendicular to said axis of rotation;

the portion of said transverse end face into which said balancing enclosure opens out is plane and perpendicular to said axis of rotation;

the mechanism includes distribution ducts which are formed in the internal fluid distributor, which are split up into a first group of pairs of distribution ducts and a second group of pairs of distribution ducts, with each pair comprising first distribution duct and a second distribution duct, whereas the shapes of the walls delimiting the main enclosures also provide the balancing of the pressure forces of the fluid contained in the first and second distribution ducts of the first group of pairs of distribution ducts, respectively, said two main enclosures then also constituting two first balancing enclosures; and at least one second balancing enclosure which is constituted by one of said chambers formed in the internal fluid distributor and opening out into its transverse end face and by one of said sealing devices partially received in said chamber, and which is connected by at least one duct formed in the internal fluid distributor to one of the two sets of distribution ducts comprising a first set, the first distribution ducts of the second group of pairs of distribution ducts, and a second set, the second distribution ducts of said second group of pairs of distribution ducts;

in a first variant embodiment, the mechanism is of the type including at least one large and at least one small operating cylinder capacity, and including: the said two main enclosures one of which is suitable for containing the feed fluid and the other the exhaust fluid, when the mechanism is operating with each of said two operating cylinder capacities, the shapes of the walls delimiting said main enclosures also providing balancing of the pressure forces of the fluid contained in the distribution ducts which are permanently in communication with said main enclosures; and two secondary enclosures one of which contains the feed fluid and the other of which contains the exhaust fluid when the mechanism is operating with said large operating cylinder capacity, and which communicate with each other when the mechanism is operating with said small operating cylinder capacity; whereas the two said secondary enclosures are associated with respective ones of the two said second balancing enclosures, each being connected via at least one internal duct formed through the internal fluid distributor to one of said secondary enclosures;

in a second variant embodiment, the mechanism is of the type including at least one large and at least one small operating cylinder capacity, the mechanism including: said two main enclosures one of which is suitable for containing the feed fluid and the other the exhaust fluid, when the mechanism is operating at each of said two operating cylinder capacities, the shapes of the walls delimiting said main enclosures further providing balancing of the pressure forces contained in the distribution ducts which are permanently in communication with said main enclosures; and a single secondary enclosure which contains one of the exhaust and feed fluids when the mechanism is operating with said large operating cylinder capacity and which contains the other one of said fluids when the mechanism is operating with said small operating cylinder capacity; whereas said single secondary enclosure is associated with a single one of said second balancing enclosures connected via at least one internal duct passing through the internal fluid distributor to said single secondary enclosure;

in a third variant embodiment, the mechanism is of the type having a single operating cylinder capacity and includes: the two main enclosures one suitable for containing the feed fluid and the other the exhaust fluid; and said two second balancing enclosures one of which is connected via said internal ducts formed through the internal fluid distribution to the first distribution ducts of the second group of pairs of distribution ducts, the other one of which is connected via said internal ducts formed through the internal fluid distributor to the second distribution ducts of said second group of pairs of distribution ducts.

The main advantages of the invention lie firstly in the implementation of a pressure fluid mechanism having at least two distinct operating cylinder capacities and including an internal fluid distributor that occupies less space axially than known prior mechanisms, and that is consequently better able to provide good sealing between the distribution face and the communication face of the cylinder block, and is thus better at reducing fluid leaks between said two faces in mutual contact, and secondly in the possibility of providing a manufacturing range including both mechanisms having a plurality of operating cylinder capacities and mechanisms each having only one operating cylinder capacity, using a single design for the part which is most bulky and in the end the most expensive, which remains completely unchanged for both types of mechanism.

BRIEF DESCRIPTION OF THE DRAWINGS

Embodiments of the invention are described by way of example with reference to the accompanying drawings, in which.

DETAILED DESCRIPTION

Figure 1:
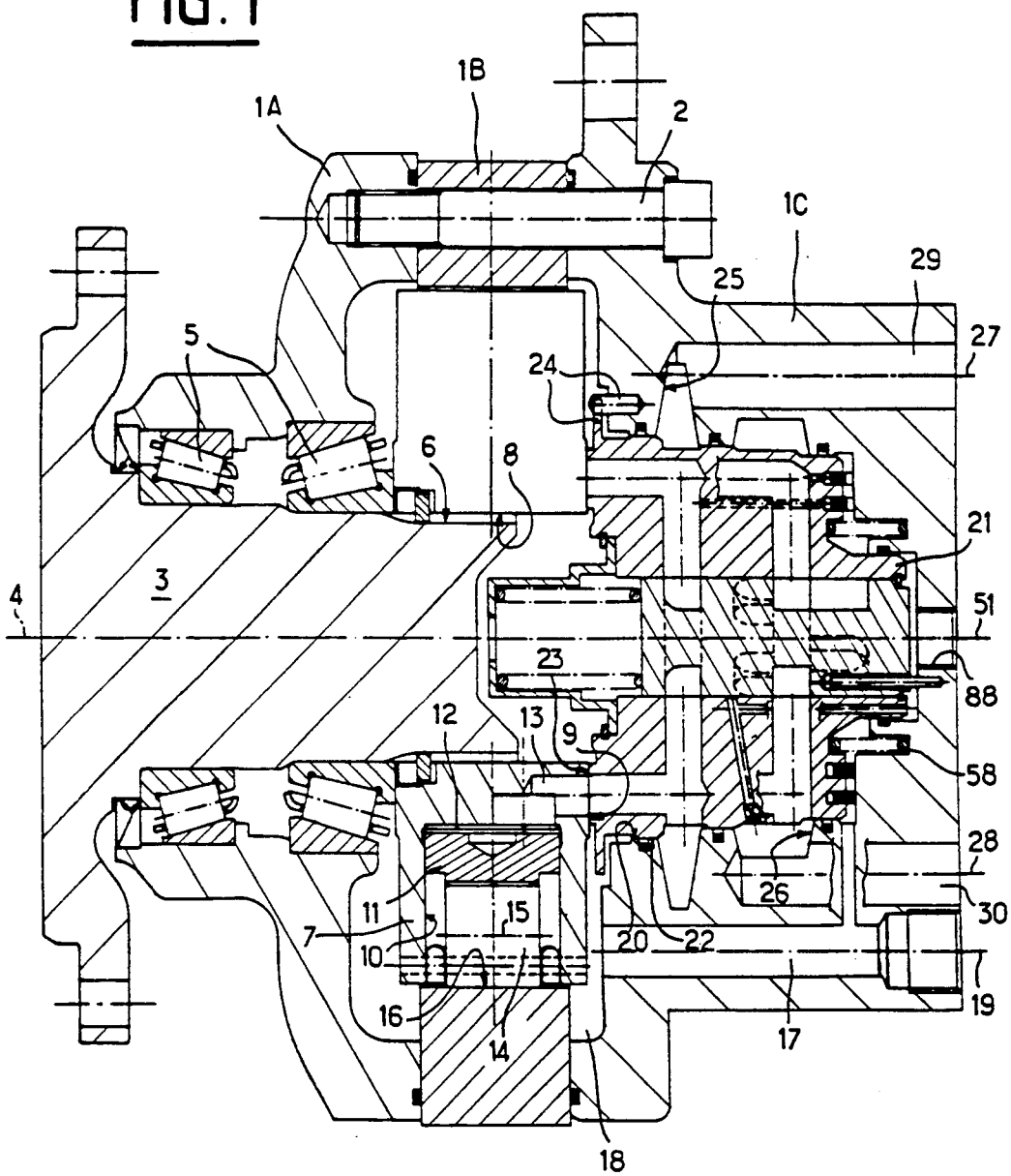
FIG. 1 is an axial section through a hydraulic motor constituting a first embodiment of the invention and shown in a first operating configuration.
Figure 2:
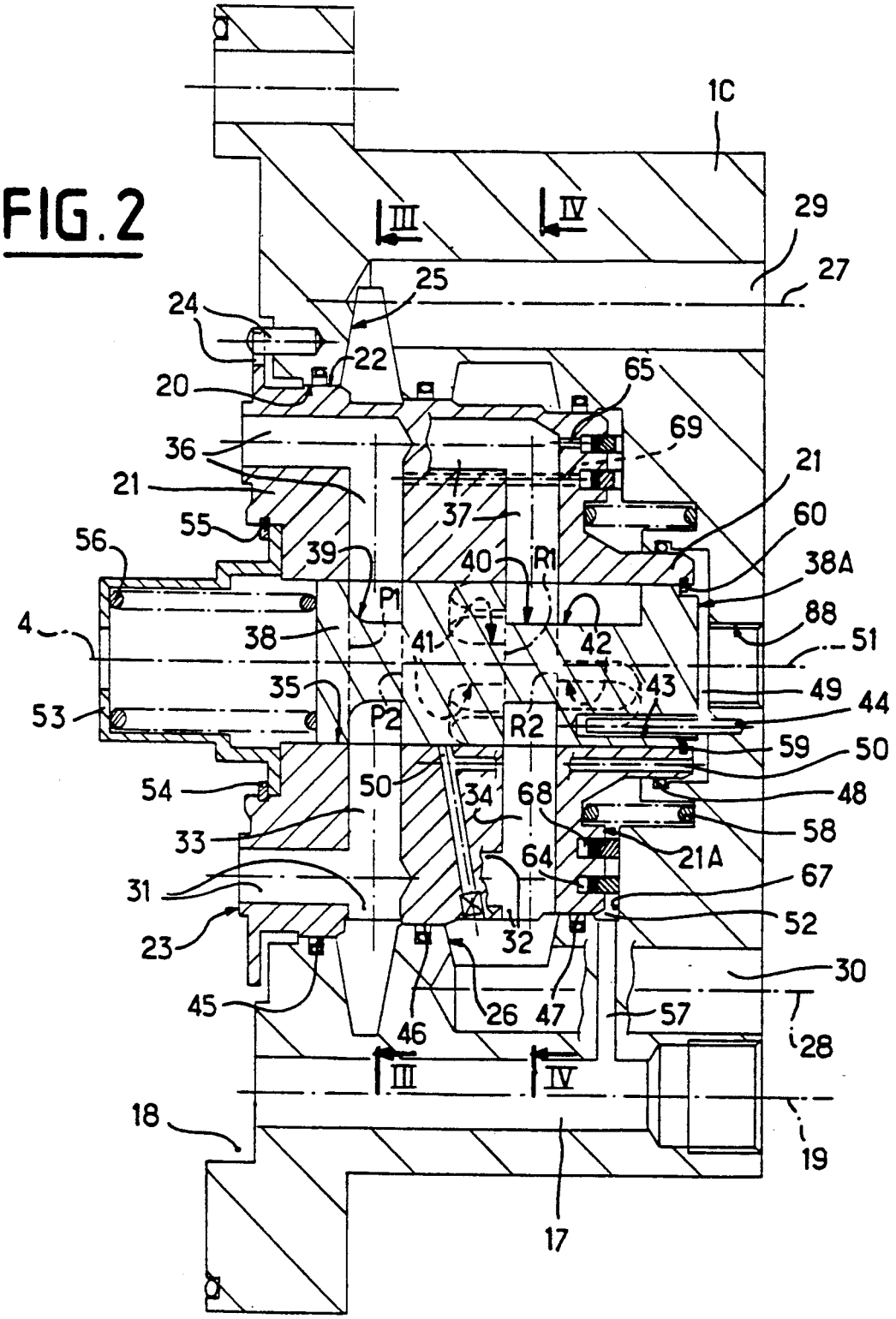
FIG. 2 is an enlargement of the portion of FIG. 1 that show the internal fluid distributor of the hydraulic motor.
Figure 3:
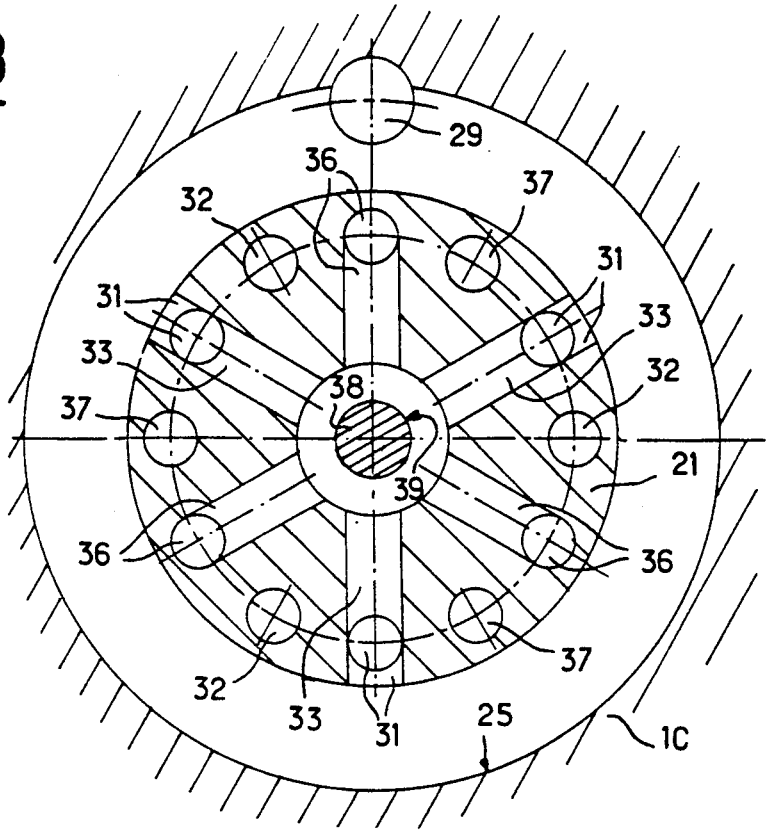
FIGS. 3 and 4 are cross-sections respectively in III—III and on IV—IV of the motor shown in FIG. 2.
Figure 4:
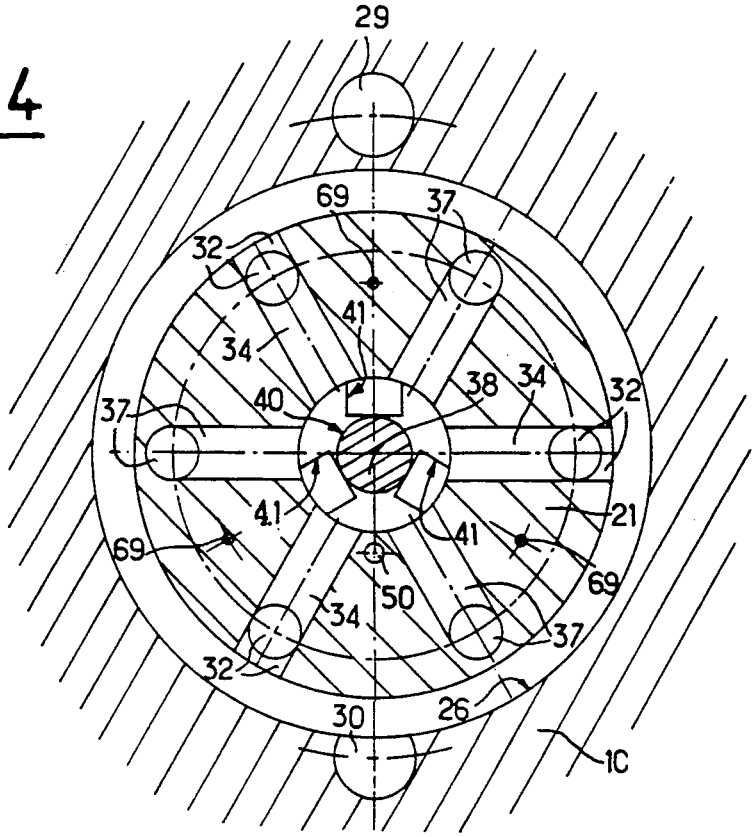
Figure 5:
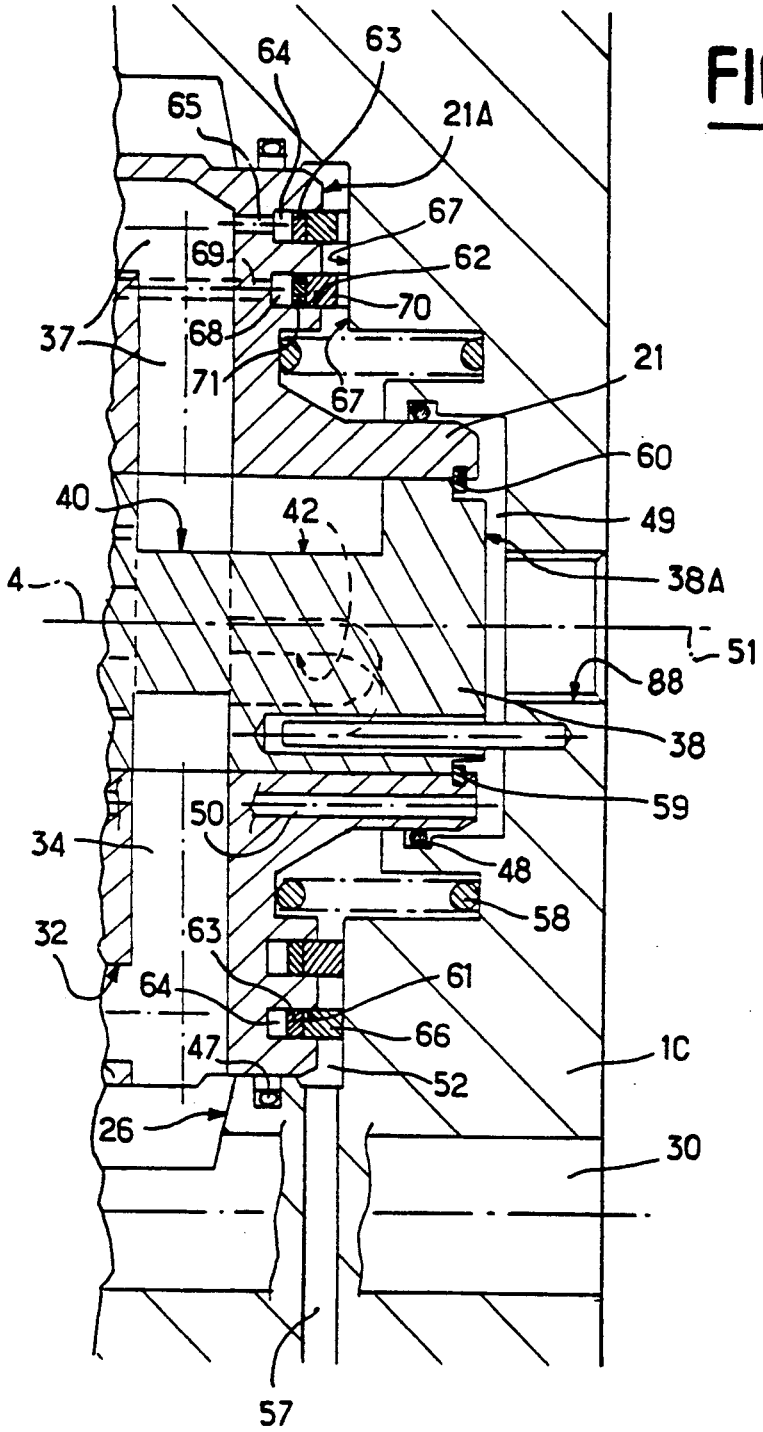
FIG. 5 is an enlargement of portions of FIGS. 1 and 2 showing more particularly the disposition that is specific to the invention.

The hydraulic motor shown in FIGS. 1 to 9 is a motor having two distinct operating cylinder capacities with so-called "symmetrical" distribution. This motor comprises:

a three-part case 1A, 1B, and 1C, the parts being assembled by screws 2;

a drive shaft 3 mounted to rotate relative to the case 1A-1B-1C about an axis of rotation 4, by means of a roller bearings 5, the drive shaft having one end contained inside the case and including fluting 6;

a cylinder block 7 having a central bore provided with fluting 8, co-operating with the fluting 6 to constrain said cylinder block 7 to rotate with the drive shaft 3 about the axis of rotation 4, said cylinder blocks including a plane communication base 9 perpendicular to the axis of rotation 4;

a plurality of cylinders 10 formed in the cylinder block 7, being disposed radially about the axis of rotation 4 and being regularly spaced apart angularly;

a plurality of pistons 11 received in the cylinders 10, one piston per cylinder, being slidably mounted in respective cylinders 10 and defining within each cylinder a fluid working chamber 12 which communicates with the communication face 9 via a cylinder duct 13;

rollers 14 each mounted at the outside end of a piston 11 to rotate relative to said piston about an axis 15 parallel to the axis of rotation 4, and bearing against the inside face of the intermediate part 1B of the case, which face constitutes an undulating reaction cam 16;

a duct 17 formed through the part 1C of the case, connecting the enclosure 18 delimited by said case to an external duct 19;

said part 1C of the case including a central circularly symmetrical recess 20 whose axis of symmetry coincides with the axis of rotation 4;

an internal fluid distributor 21 having an axial peripheral face 22 which is substantially complementary in shape to the recess 20 and having a plane distribution face 23 perpendicular to the axis of rotation 4 and pressing in substantially sealed manner against the communication face 9, a device comprising associated notches and lugs 24 constraining the internal fluid distributor 21 to rotate with the part 1C of the case about the axis of rotation 4;

two main enclosures 25 and 26 formed between the internal fluid distributor 21 and the recess 20 communicating with external ducts 27 and 28 via respective ducts 29 and 30 formed through the part 1C of the case;

a first group of distribution ducts 31, 32 corresponding in pairs of ducts 31–32 with the undulations in a first group of undulations on the reaction cam 16, with the distribution ducts 31 permanently in communication with the main enclosure 25 and the distribution ducts 32 permanently in communication with the main enclosure 26, the ducts opening out into the distribution face 23 in such a manner that during relative rotation between the cylinder block and the case 1A-1B-1C, and consequently relative to the internal fluid distributor 21, they communicate periodically with the cylinder ducts 13;

link ducts 33 and 34 connecting at least one of the distribution ducts 31 and 32 and thus the main enclosures 25 and 26 to a bore 35 formed in the internal fluid distributor 21 into which said link ducts open out, the link ducts 33 being between two transverse planes P1 and P2 perpendicular to the axis 4, and the link ducts 34 being between two transverse planes R1 and R2, also perpendicular to the axis 4;

a second group of distribution ducts 36 and 37 corresponding in pairs of distribution ducts 36–37 to the undulations of a second group of undulations of the reaction cam 16 with the distribution ducts 36 communicating with the bore 35 by opening out therein between the transverse planes P1 and P2, and with the distribution ducts 37 communicating with the bore 35 by opening out therein between the transverse planes R1 and R2, said distribution ducts 36 and 37 also opening out into the distribution face 23 in such a manner that during relative rotation between the cylinder block 7 and the case 1A-1B-1C they communicate periodically with the cylinder ducts 13; said ducts 36 and 37 respectively constituting two secondary enclosures;

a slider 38 mounted to slide in sealed manner inside the bore 35 and including: two axially spaced apart grooves 39 and 40; axial blind ducts 41 and 42 which extend across the groove 40 and are permanently in communication therewith and with the bore 35; and an axial housing 43 slidably receiving a rotary positioning pin 44 for rotary positioning relative to the part 1C of the case, and fixed to said part 1C;

sealing gaskets 45, 46, 47, and 48 interposed between the internal fluid distributor 21 and the part 1C of the case and isolating each main enclosure 25 and 26 from the other enclosure and from the inside of the case (gaskets 45, 46, 47) and isolating a pilot chamber 49 provided in the part 1C of the case between the case and the end of the internal fluid distributor furthest from the distribution face 23 and an end 38A of the slide 38;

a duct 50 formed between the internal fluid distributor 21 opening out firstly into the bore 35 and secondly into the chamber 49;

an internal reaction abutment 53 fixed on the central portion of the internal fluid distributor 21 by a segment 54 received in a groove 55 of said internal fluid distributor holding a spring 56 which is interposed between itself and the slide 38 so that the effect of the spring which opposes the effect of the pressure of the fluid contained in the chamber 49 tends to urge the slide 38 into a first position (FIGS. 1 to 5) in which the ducts 33 and 36 communicate with the groove 39, the ducts 34 and 37 communicate with the groove 40, the ducts 41 and 42 communicate only with the groove 40, and the duct 50 is closed by the slide 38;

an external duct 51 connected to the chamber 49 and suitable for conveying fluid under pressure so as to place the slide 38 in a second position (FIG. 6) in which, firstly the groove 40 closed by the bore 35 nevertheless communicates with the ducts 36 and 37 via the blind ducts 41 and 42, and secondly the duct 50 opens out facing said groove 40;

a chamber 52 delimited between the internal fluid distributor 21 and the part 1C of the case between the gaskets 47 and 48, and being permanently in communication with the duct 17 via a duct 57, likewise formed through the part 1C of the case;

a spring 58 interposed between the internal fluid distributor 21 and the part 1C of the case, urging the distributor face 23 to press in substantially sealed manner against the communication face 9 of the cylinder block 7;

a segment 59 received in a groove 60 formed in the bore 35 of the internal distributor 21 and constituting an abutment for limiting sliding of the slide 38, which slide is in its first position when it presses against said segment 59;

two circularly symmetrical grooves 61 and 62 about an axis that coincides with the geometrical axis 4 opening out into the plane rear face 21A perpendicular to the geometrical axis 4 of the fluid distributor 21 and being delimited by cylindrical axial walls;

the groove 61 receiving a gasket 63 which co-operates with the bottom of the groove to delimit a chamber 64 communicating with the ducts 37 via at least one duct 65 formed in the internal fluid distributor 21, a segment 66 being inserted in the groove 61 after the gasket 63, and bearing against an internal face 67 of the part 1C of the case, which face is plane and extends perpendicularly to the geometrical axis 4; and the groove 62 receiving a gasket 71 which co-operates with the bottom of said groove to delimit a chamber 68 communicating with the ducts 36 via at least one duct 69 formed through the internal fluid distributor 21, a segment 70 being inserted in the groove 62 after the gasket 71, and bearing against the face 67 of the part 1C of the case.

It should be observed that the structure of the motor shown in FIGS. 1 to 9 corresponds, for example, to the case 1A-1B-1C being fixed to a vehicle chassis with the cylinder block 7 and the drive shaft 3 rotating, which shaft is constrained to rotate with and is coupled to a displacement member of said vehicle for the purpose of driving the vehicle. There exist other types of motor in which the rotary member is constituted by the case (and by the cam which is constrained to rotate therewith), while the stationary member is constituted by the cylinder block. In such a motor, the end transverse face 21A of the internal distributor 21 is disposed facing a transverse face of the cylinder block which is analogous to the face 67 of the motor described above. In both configurations, the face 67 of the case, like said face of the cylinder block, constitutes a reaction face against which the segments 66 and 70 can bear. The above observation referring specifically to the embodiments of FIGS. 1 to 9, is also applicable to the embodiments of FIGS. 10 to 15 and of FIGS. 16 to 18.

Figure 9:
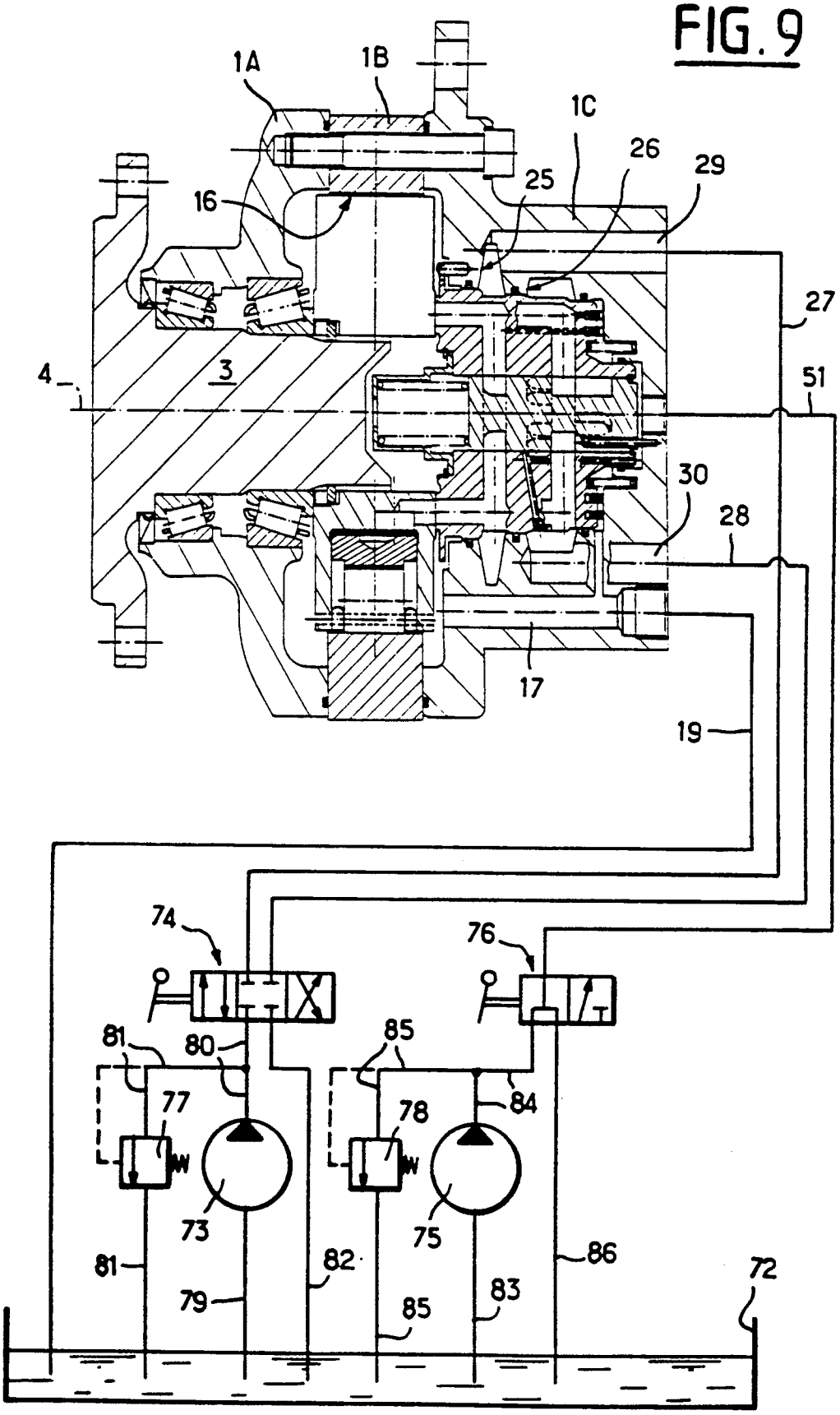
FIG. 9 shows the control circuit for the hydraulic motor of FIGS. 1 to 8.

The diagram of FIG. 9 shows the hydraulic motor as described above in its configuration as shown in FIGS. 1 to 5, and its hydraulic circuit which comprises:

said motor;

a tank 72 of fluid that is not under pressure;

a main pump 73;

a main fluid distributor 74 having three positions;

a secondary pump 75;

a secondary fluid distributor 76 having two positions;

two discharge non-return valves 77 and 78 providing protection against excess pressure; and the following ducts:

a suction duct 79 for the main pump 73 connecting it to the tank 72;

a delivery duct 80 from the main pump 73 connecting it to the main fluid distributor 74;

a duct 81 connecting the delivery duct 80 to the tank 72 and on which the discharge valve 77 is placed;

a duct 82 connecting the main fluid distributor 74 to the tank 72;

a suction duct 83 of the secondary pump 75, connecting it to the tank 72;

a delivery duct 84 of the secondary pump 75, connecting it to the secondary fluid distributor 76;

a duct 85 connecting the delivery duct 84 to the tank 72 and having the discharge valve 78 placed thereon; and a duct 86 connecting the secondary fluid distributor 76 to the tank 72.

It should be observed that the ducts 27 and 28 are connected to the main fluid distributor 74; that the duct 51 is connected to the secondary fluid distributor 76; and that the duct 19 is connected to the tank 72.

The three positions of the main fluid distributor 74 correspond as follows:

the first position to communication between the ducts 80 and 27 and between the ducts 28 and 82;

the second position to all four ducts 27, 28, 80, and 82 being closed; and the third position to the ducts 80 and 28 being in communication while the ducts 27 and 82 are in communication.

The two positions of the secondary fluid distributor 76 correspond as follows:

the first position to the ducts 84, 51, and 86 being put into communication and to the hydraulic motor and its slide 38 being in a first configuration; and the second position to the ducts 84 and 51 being put into communication while the duct 86 is closed, and to the hydraulic motor and its slide 38 being in a second configuration.

The hydraulic motor shown in FIGS. 10 to 15 is a motor having two distinct cylinder capacities in operation and having so-called "asymmetric" distribution. Like the motor of FIG. 1 on which it is based, this motor comprises:

a three-part case 1A, 1B, and 1C in which the parts are assembled by screws 2;

a drive shaft 3 mounted to rotate relative to the case 1A-1B-1C about an axis of rotation 4 by means of roller bearings 5, one end of the drive shaft being contained inside the case and including fluting 6;

a cylinder block 7 having a central bore provided with fluting 8 that co-operates with the fluting 6 to constrain the cylinder block 7 to rotate with the drive shaft 3 about the axis 4, said cylinder block including a plane communication face 9 perpendicular to the axis of rotation 4;

a plurality of cylinders 10 formed in the cylinder block 7, disposed radially about the axis of rotation 4 and regularly spaced apart angularly;

a plurality of pistons 11 received in respective cylinders 10 mounted to slide inside their cylinders 10 and defining in each cylinder a fluid working chamber 12 which communicates with the communication face 9 via a cylinder duct 13;

rollers 14 each mounted at the outside end of a piston 11 to rotate relative to said piston about an axis 15 parallel to the axis of rotation 4 and bearing against the inside face of the intermediate part 1B of the case, which constitutes an undulating reaction cam 16; and a duct 17 formed in the part 1C of the case connecting the enclosure 18 delimited by said case to an external duct 19.

The motor of FIGS. 10 to 15 also has the following dispositions, that are novel relative to the motor of FIG. 1:

the part 1C in the case includes in a circularly symmetrical central recess 220 whose axis of symmetry coincides with the axis of rotation 4;

an internal fluid distributor 221 having an axial peripheral face 222 which is substantially complementary in shape to the shape of the recess 220 and which has a plane distribution face 223 perpendicular to the axis of rotation 4 and bearing in substantially sealed manner against the communication face 9, a device 224 comprising associated notches and lugs constraining the internal fluid distributor 221 to rotate with the part 1C of the case about the axis of rotation 4;

two main enclosures 25 and 26 formed between the internal distributor 221 and the recess 220, and communicating with the external ducts 27 and 28 via respective ducts 29 and 30 formed through the part 1C of the case;

a first group of distribution ducts 31 and 32 corresponding in pairs of ducts 31–32 to the undulations of a first group of undulations of the reaction cam 16 with the distribution ducts 31 permanently in communication with the main enclosure 35 and with the distribution ducts 32 permanently in communication with the main enclosure 26, the ducts opening out into the distribution face 223 in such a manner that during relative rotation of the cylinder block 7 and the case 1A-1B-1C, and consequently during relative rotation of the cylinder 7 and the internal fluid distributor 221, they communicate periodically with the cylinder ducts 13;

link ducts 33 and 34 connecting at least one of the distribution ducts 31 and 32, and thus connecting the main enclosures 25 and 26, to a bore 235 formed inside the internal fluid distributor 221, into which said link ducts 34 open out between two transverse planes R1 and R2 extending perpendicularly to the axis 4;

a second group of distribution ducts 236 and 237 corresponding in pairs of distribution ducts 236–237 to the undulations in a second group of undulations of the reaction cam 16, the distribution ducts 236 communicating permanently with the main enclosure 25 and the distribution ducts 237 communicating permanently with the bore 235 opening out therein between the transverse planes R1 and R2, said distribution ducts 236 and 237 also opening out into the distribution face 223 in such a manner that during relative rotation of the cylinder block 7 relative to the case 1A-1B-1C, they communicate periodically with the cylinder ducts 13;

a slide 238 mounted to slide in sealed manner inside the bore 235 includes: a groove 240; axial blind ducts 242 which are permanently in communication with the groove 240 and with the bore 235; and an axial housing 243 for slidably receiving a rotary positioning pin 244 for rotary positioning relative to the part 1C of the case and fixed on the part 1C of the case;

gaskets 245, 246, 247, and 248 interposed between the internal fluid distributor 221 and the part 1C of the case and isolating each of the main enclosures 25 and 26 from the other enclosure and from the inside of the case (gaskets 245, 246, and 247), and isolating a pilot chamber 249 formed in the part 1C of the case between said part of the case, the end of the internal fluid distributor furthest from the distribution face 233, and an end 238A of the slide 238;

an internal reaction abutment 253 fixed on the central portion of the internal fluid distributor 221 by a segment 254 received in a groove 255 of said internal fluid distributor serving to hold a spring 256 which is interposed between itself and the slide 238 and disposed to oppose the effect of the pressure of the fluid contained in the chamber 249, tending to place the slide 238 in a first position (FIGS. 10, 11, and 12) in which the ducts 34 and 237 communicate with the groove 240, while the ducts 242 communicate only with the groove 240;

an external duct 51 connected to the chamber 249 and suitable for conveying fluid under pressure for the purpose of placing the slide 238 in a second position (FIGS. 13, 14, and 15), in which the groove 240 communicates with the ducts 33 and, via the blind ducts 242, with the ducts 237; the ducts 34 then being closed by the slide 238;

a chamber 252 delimited between the internal fluid distributor 221 and the part 1C of the case, between the gaskets 247 and 248, and permanently in communication with the duct 17 via a duct 257 which is also formed through the part 1C of the case;

a spring 258 interposed between the internal fluid distributor 221 and the part 1C of the case, and tending to cause the distribution face 223 to bear in substantially sealed manner against the communication face 9 of the cylinder block 7;

a segment 259 received in a groove 260 formed in the bore 235 of the internal distributor 221, and constituting an abutment limiting the sliding of the slider 238 which is disposed in its first position when it bears against segment 259; and a circularly symmetrical groove 261 about the geometric axis 4 opening out into the plane rear face 221A perpendicular to the geometrical axis 4 of the internal fluid distributor 221 and delimited by cylindrical axial walls; the groove 261 receiving a gasket 263 which co-operates with the bottom of the groove to delimit a chamber 264 communicating with the ducts 237 via at least one duct 265 formed through the internal fluid distributor 221, a segment 266 being inserted in the groove 261 after the gasket 263, and bearing against the face 67 of the part 1C of the case.

The motor of FIGS. 10 to 15 can be inserted in the circuit of FIG. 9 without making any changes to the circuit.

Figure 16:
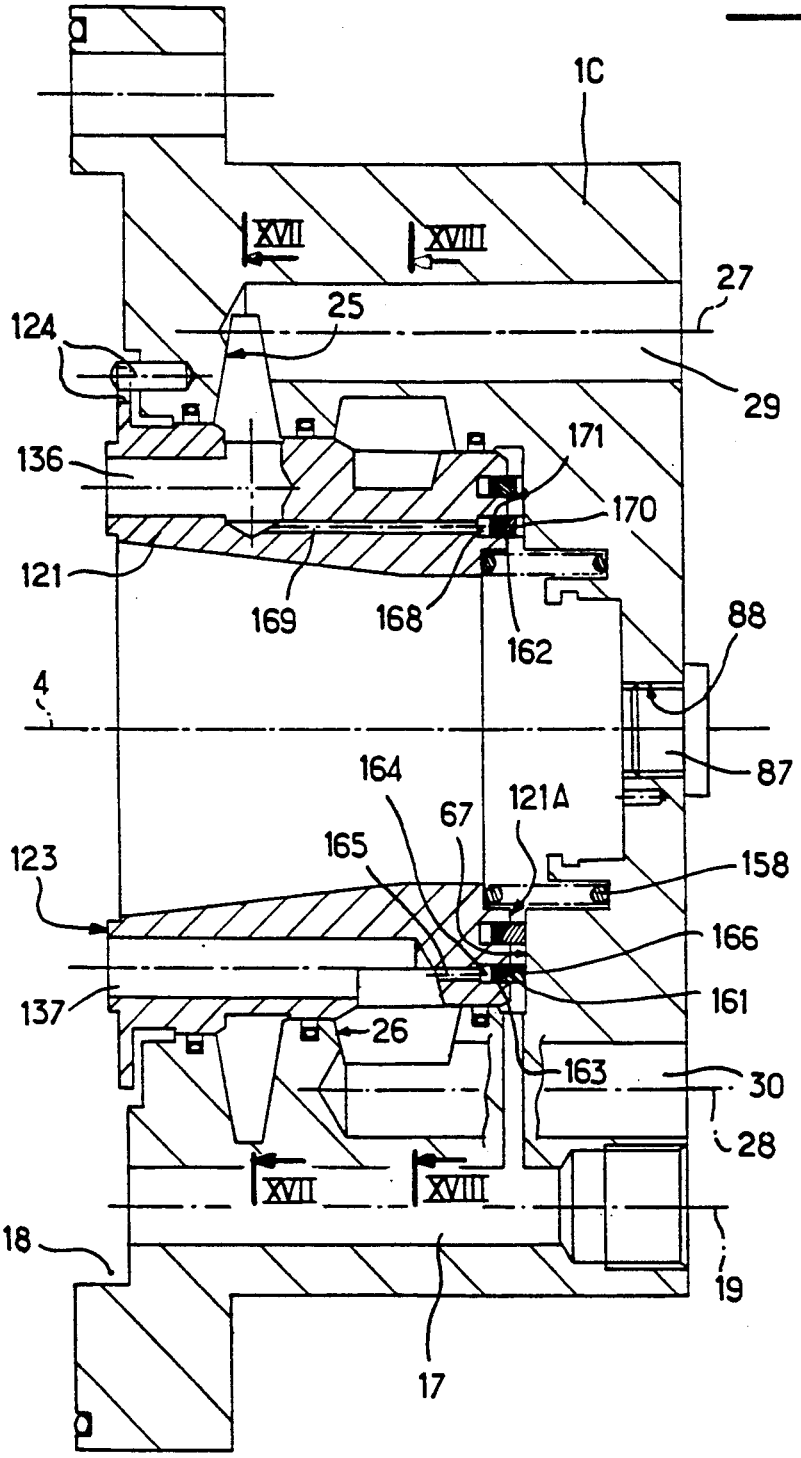
FIG. 16 is an axial section analogous to FIG. 2 of a hydraulic motor constituting a third embodiment of the invention, and shown in section on a plane XVI—XVI of FIG. 17.
Figure 17:
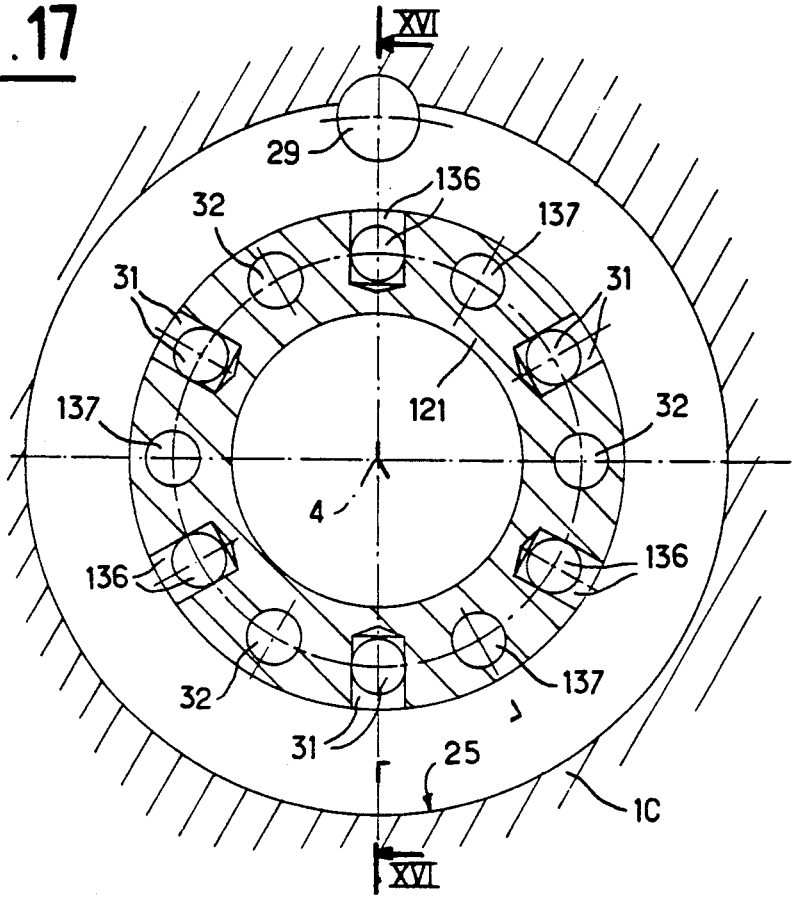
FIGS. 17 and 18 are cross-sections respectively on XVII—XVII and XVIII—XVIII through the motor shown in FIG. 16.
Figure 18:
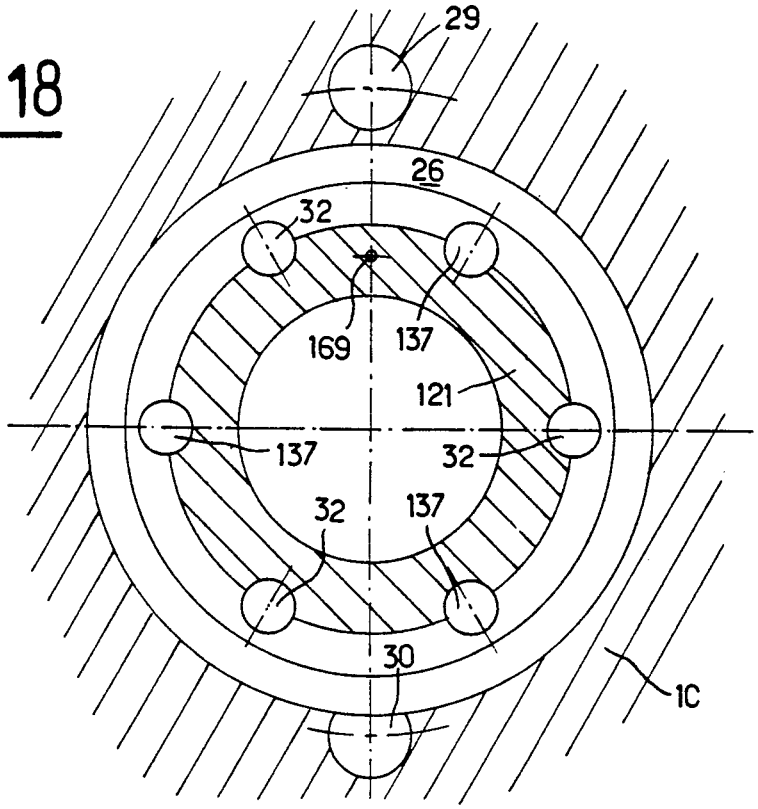

The hydraulic motor of FIGS. 16 to 18 is a motor that has only one operating cylinder capacity. This motor is similar to the motor shown in FIGS. 1 to 9 except with respect to the following characteristics: its internal fluid distributor 121 is different and replaces the distributor 21, thereby eliminating the slide 38, the ducts 36, 37, and 50, and naturally the housing 43 and the rotary positioning pin 44.

Thus, the distribution ducts 31–136, 32–137 correspond in pairs of distribution ducts 31–32, 136–137, to the undulations of the reaction cam 16, with the ducts 31 and 136 permanently in communication with the main enclosure 25 and with the ducts 32 and 137 permanently in communication with the main enclosure 26; the ducts opening out into a plane distribution face 123 of the internal fluid distributor 121, which face is perpendicular to the geometrical axis 4 such that during relative rotation of the cylinder block 7 and the case 1A-1B-1C and consequently between the cylinder block and the internal fluid distributor 121 which is constrained to rotate with the part 1C of the case by means of a device 124 comprising associated notches and lugs, the ducts are caused to communicate periodically with the cylinder ducts 13.

The ducts 31 and 32 communicate with the main enclosures 25 and 26 whose shapes, as before, are selected to provide hydrostatic balancing of the thrust due to the pressure of the fluid contained in the ducts 31 and 32 and acting on the fluid distributor 121.

In contrast, the ducts 136 and 137 which are placed in the locations of the ducts 36 and 37 of the embodiment of FIGS. 1 to 9, and which are present in that the same numbers as the ducts 36 and 37, give rise to hydrostatic thrust due to the effect of the pressure of the fluid they contain, which is balanced no better than that generated by the fluid contained in the ducts 36 and 37 of the motor of FIGS. 1 to 9, therefore giving rise to thrust that is not balanced by the shapes selected for the enclosures 25 and 26. For this reason, grooves 161 and 162 analogous to the grooves 61 and 62 are provided and perform the same function relative to the ducts 136 and 137 as do the grooves 61 and 62 relative to the ducts 36 and 37.

These grooves 161 and 162 are formed through the internal fluid distributor 121, opening out into the plane back face 121A thereof extending perpendicularly to the geometrical axis 4 and facing the inside face 67 of the part 1C of the case.

Gaskets 163 and 171 associated with the segments 166 and 170 pressing against the face 67 define chambers 164 and 168 which communicate with the ducts 137 and 136 via respective ducts 165 and 169 formed through the internal fluid distributor 121.

A spring 158 interposed between the internal fluid distributor 121 and the part 1C of the case tends to urge the distribution face 123 to press in substantially sealed manner against the communication face 9 of the cylinder block 7.

Finally, a plug 87 is screwed into tapping 88 for connection to the duct 51 in the embodiments of FIGS. 1 to 9, which tapping 88 is formed in the part 1C of the case.

It should be observed that apart from the internal fluid distributor 121 and the devices associated therewith, the motor of FIGS. 16 to 18 is identical to that of FIGS. 1 to 9, in particular with respect to the case 1A-1B-1C, the cylinder block 7, the drive shaft 3, the reaction cam 16, and the geometrical axis 4, as described above with reference to FIGS. 1 to 9.

The operation of the above-described motors is explained below.

The motor shown in FIGS. 1 to 9 is a motor having two different cylinder capacities with "symmetrical" distribution.

When the secondary fluid distributor 76 is placed in its first position, the spring 56 acts alone on the slide 38 which it puts into the first configuration as shown in FIGS. 1 to 5, and 9. Assuming that the main fluid distributor 74 is in its first position, it can be seen that the ducts 80, 27, and 29, the groove 25, the ducts 31 and 33, the groove 39, and the ducts 36 are all fed with fluid under pressure from the main pump 73. Similarly, the ducts 32 and 37 (ducts 37 connected to the ducts 32 by the groove 40 and the ducts 34) are connected to the fluid tank 72 via the groove 26 and the ducts 30, 28, and 82. The fluid working chambers 12 are each fed with fluid under pressure when the corresponding rollers 14 are pressed against each of the undulations in the reaction cam 16. The cylinder capacity which corresponds to all of the working chambers 12 constitutes the large cylinder capacity of the motor.

The shapes of the main enclosures 25 and 26 suffice to balance the thrust due to the pressure of the fluid contained in the ducts 31 and 32 which are directly connected to said grooves, said main enclosures 25 and 26 thus also having the function of balancing enclosures for the fluid contained in the distribution ducts 31 and 32.

In contrast, the thrust due to the pressure of the fluids contained in the ducts 36 and 37 which are not directly connected to the main enclosures 25 and 26 is not balanced by the shape of said main enclosures. The set of distribution ducts 36 and the set of distribution ducts 37 constitute two distinct secondary enclosures. The fluid actuators constituted by the segments 66 and 70 associated with the gaskets 63 and 71 mounted to slide in the grooves 61 and 62 and which are fed with the fluid as contained in the ducts 37 and 36 via the ducts 65 and 69 respectively serve to obtain said balancing of the thrust due to the pressure of the fluid contained in the ducts 37 and 36, with the chambers 64 and 68 then constituting balancing enclosures for the fluid contained in the distribution ducts 36 and 37.

This balancing which is directly proportional to the pressures of said fluid is, in addition, achieved automatically.

Figure 6:
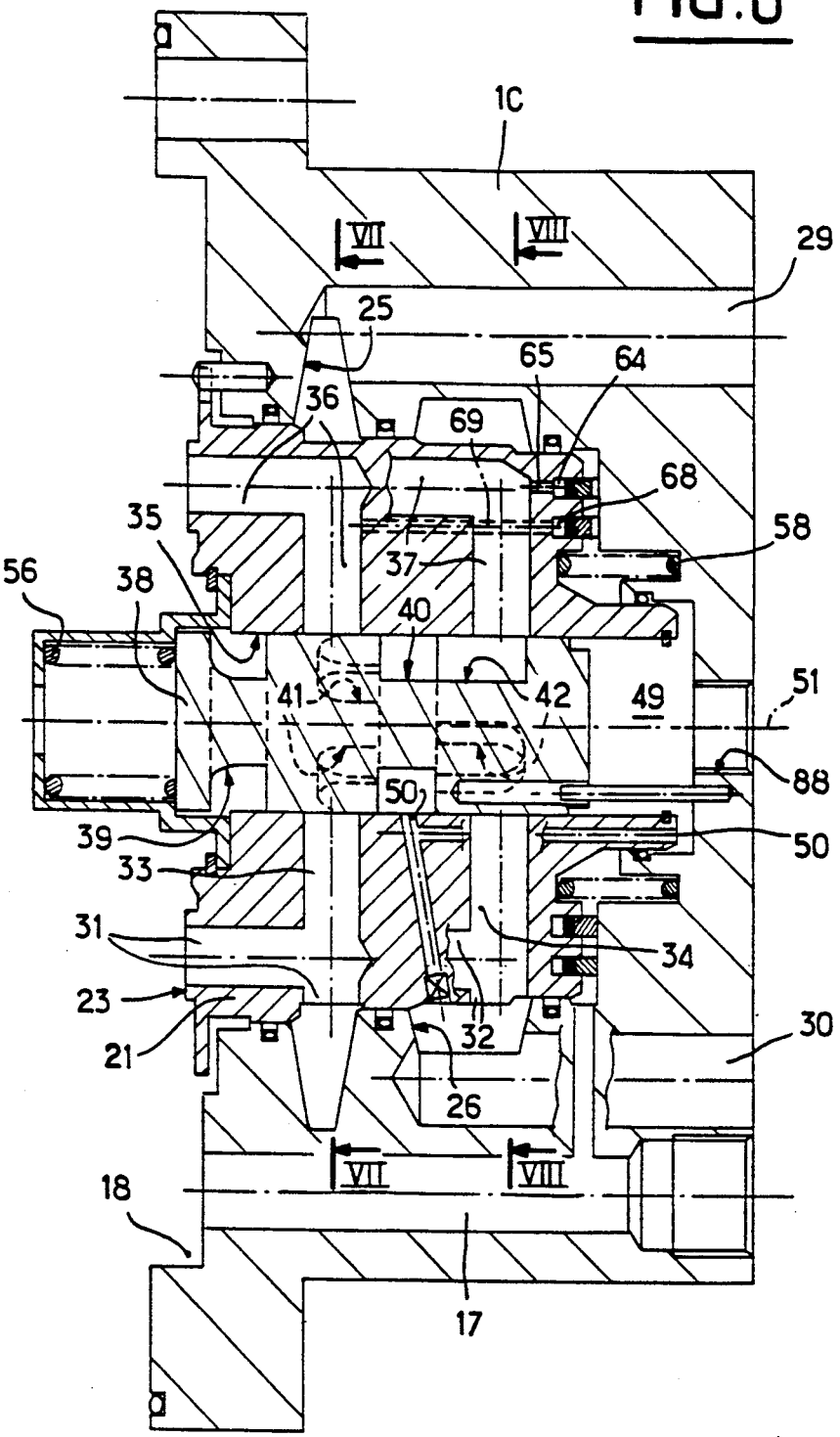
FIG. 6 is an axial section analogous to that of FIG. 2 but corresponding to a second operating configuration of the hydraulic motor.
Figure 7:
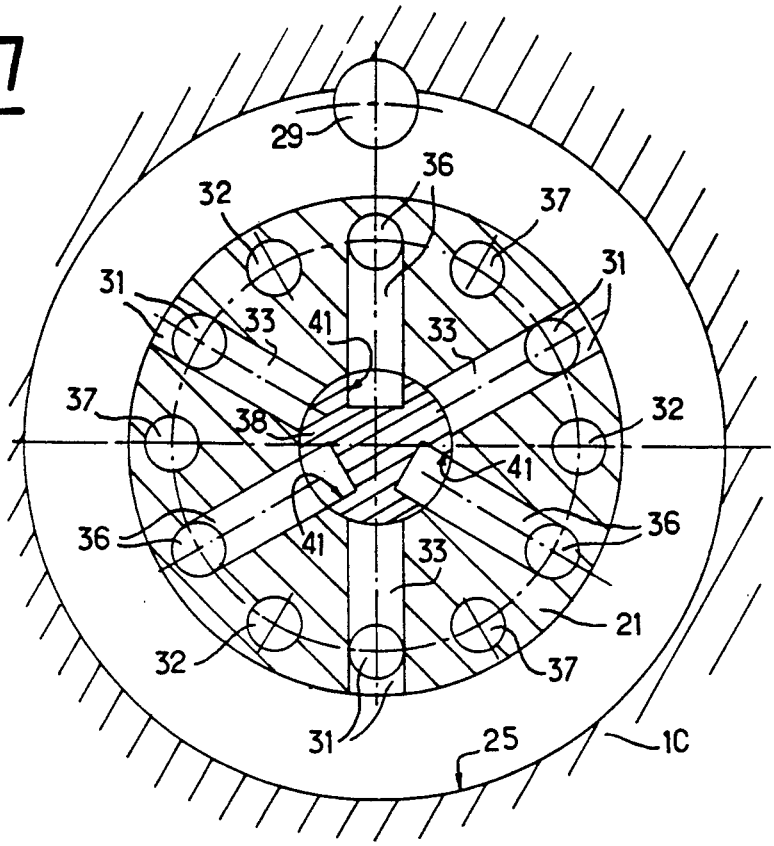
FIGS. 7 and 8 are cross-sections respectively on VII—VII and on VIII—VIII of the motor shown in FIG. 6.
Figure 8:
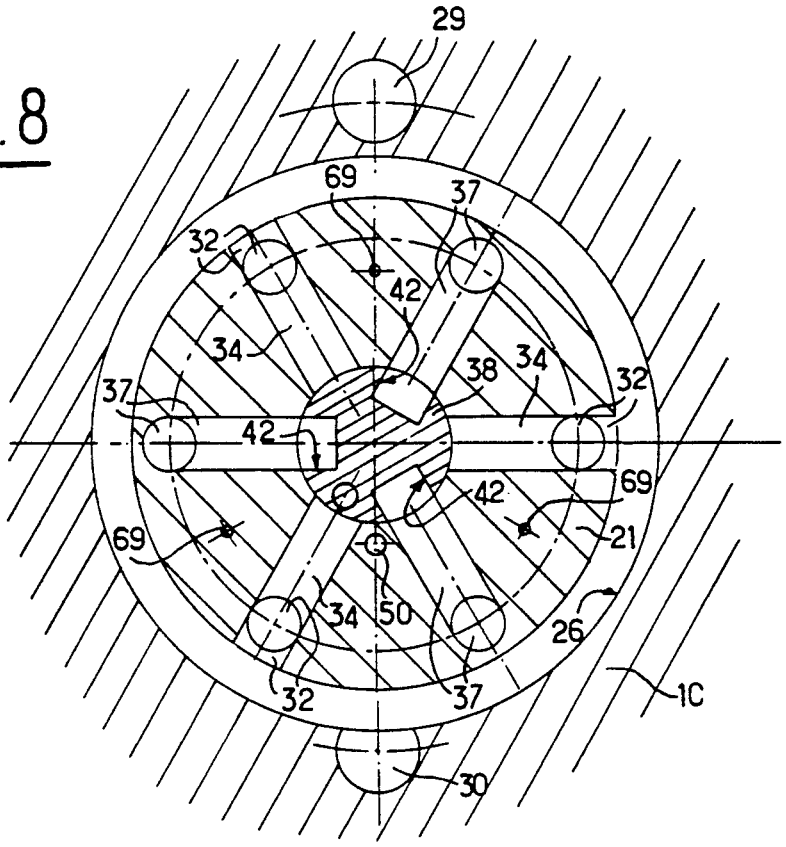

Supposing that the main fluid distributor 74 remains in its first position and the secondary fluid distributor 76 is placed in its second position, then the configuration of FIGS. 6 to 8 is obtained.

In this configuration, the ducts 36 are no longer connected to the main enclosure 25 by the groove 39 and the duct(s) 33. Only those fluid working chambers 12 that correspond to rollers 14 pressing against undulations that correspond to the ducts 31 are fed with fluid under pressure. The cylinder capacity obtained constitutes the small cylinder capacity of the motor.

The ducts 36 and 37, isolated from the ducts 33 and 34 and connected to the groove 40 by the blind ducts 41 and 42 retain their constant angular position by virtue of the positioning obtained by the combined action of the pin 44 and its housing 43, and they are put into communication with the chamber 49 via the duct 50. It should be observed that the pressure of the fluid contained in the chamber 49 is usually about 5 bars to 10 bars, whereas the pressure of the fluid delivered by the main pump 73 is usually about 400 bars. Consequently, not only do the working chambers 12 corresponding to said ducts 36 and 37 have their feed short-circuited, but they are also put into communication with fluid at low pressure.

It should also be observed that the thrust of the fluid contained in the ducts 36 and 37 is, here again, automatically balanced by the actuators 63-66-61, and 71-70-62. Naturally, the shape of the main enclosures 25 and 26 continues to provide automatic balancing of the thrust from the fluid contained in the ducts 31 and 32.

The motor shown in FIGS. 10 to 15 is a motor having two distinct cylinder capacities with so-called "asymmetrical" distribution.

Figure 10:
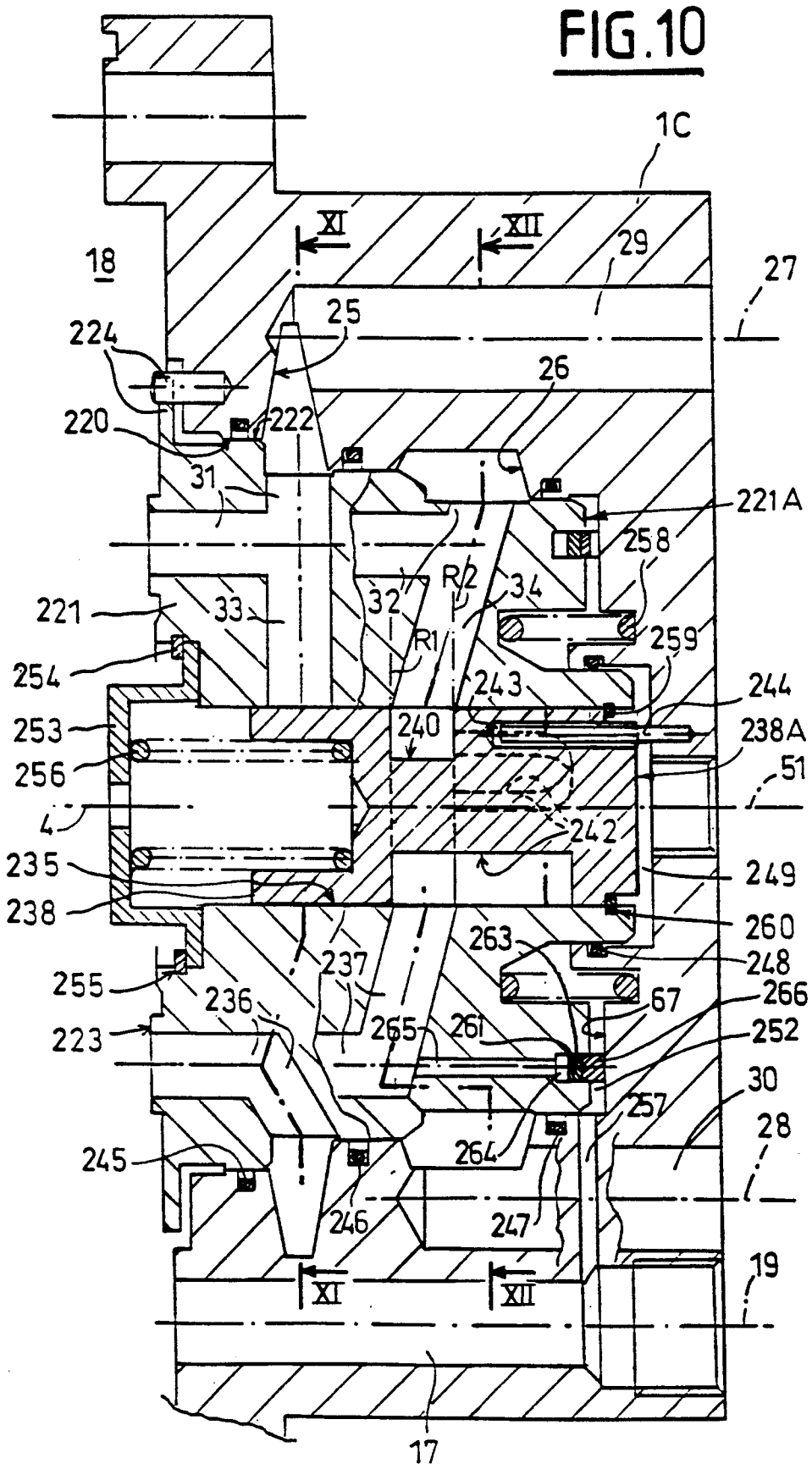
FIG. 10 is an axial section analogous to FIG. 2 showing a hydraulic motor constituting a second embodiment of the invention and shown in a first operating configuration.
Figure 12:
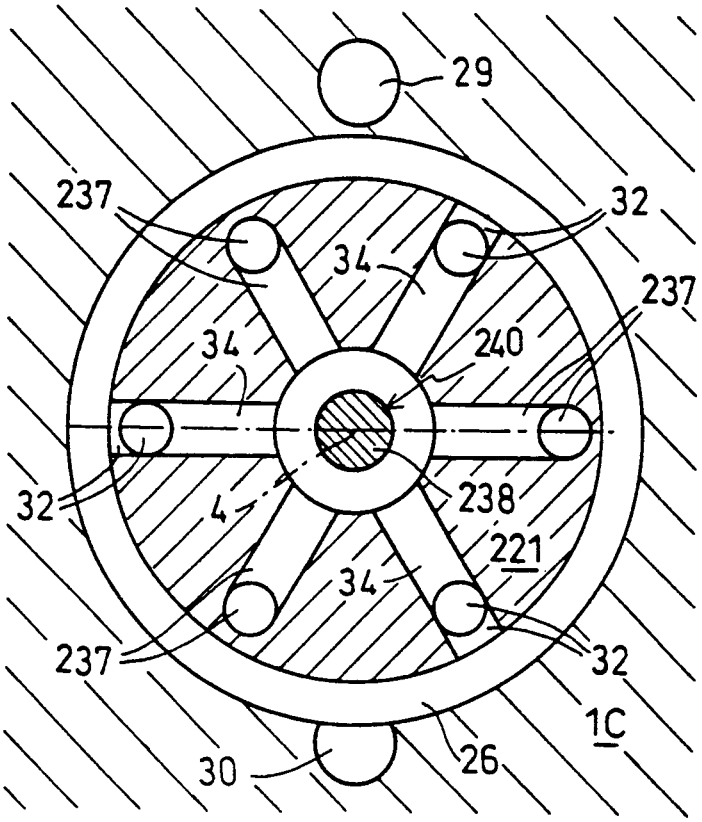
FIGS. 11 and 12 are sections respectively on XI—XI and on XII—XII of the motor shown in FIG. 10.
Figure 11:
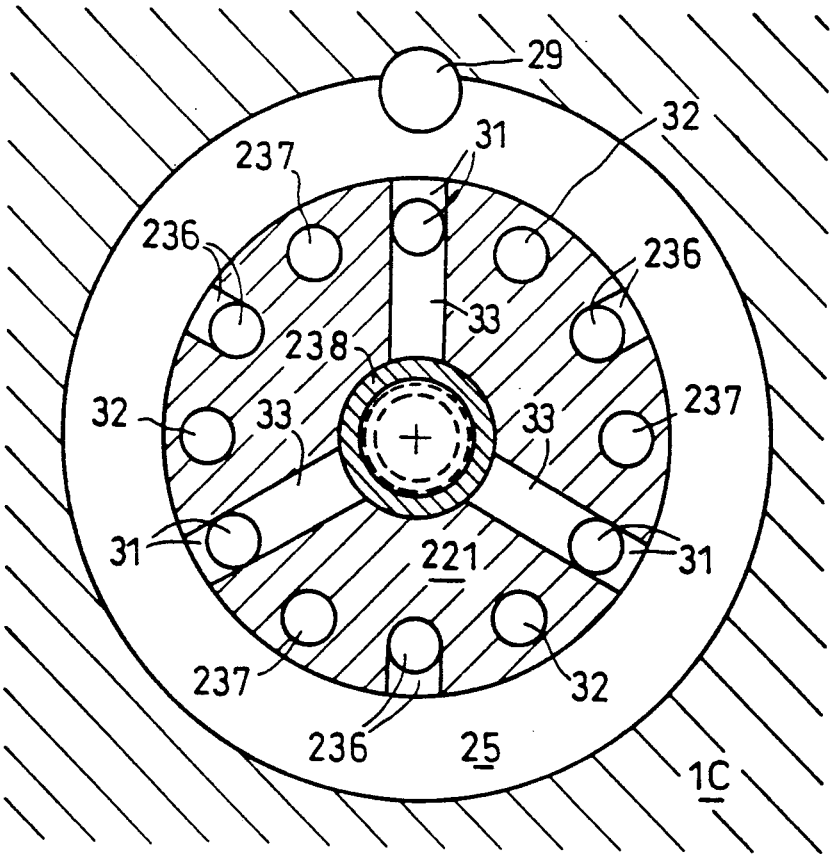

When the secondary fluid distributor 76 is placed in its first position, the spring 256 acts alone on the slide 238 and places it in the first configuration as shown in FIGS. 10 to 12. Assuming that the main fluid distributor 74 is placed in its first position, it can be seen that fluid under pressure is fed by the main pump 73 to the ducts 80, 27, and 29, to the groove 25, and to the ducts 31 and 236. Similarly, the ducts 32 and 237 are connected to the fluid tank 72 via the groove 26 and the ducts 30, 28, and 82, the groove 240 and the ducts 34 putting the ducts 237 into communication with the ducts 32. Each of the fluid working chambers 12 is fed with fluid under pressure while the rollers 14 press against each of the undulations of the reaction cam 16. The cylinder capacity, which corresponds to the total cylinder capacity of the working chambers 12 constitutes the large cylinder capacity of the motor.

The shapes of the main enclosures 25 and 26 suffice to balance the thrust due to the pressure of the fluid contained in the ducts 31 and 236 and secondly 32 respectively directly connected to said grooves. Here again, as in the case of the motor shown in FIGS. 1 to 9, the main enclosures 25 and 26 also have a balancing function for the fluid contained in the distribution ducts 31, 236, and 32.

In contrast, the thrust due to the pressure of the fluid contained in the distribution ducts 237 that are not directly connected to the main enclosures 25 and 26 is not balanced by the shape of the main enclosures. The set of said distribution ducts 237 constitutes a secondary enclosure. The fluid actuator constituted by the segment 266 associated with the gasket 263 slidably mounted in the groove 261 which is fed with the fluid contained in the ducts 237 and the ducts 265, makes it possible to obtain balancing of the thrust due to the pressure of the fluid contained in the ducts 237. The chamber 264 then constitutes a balancing chamber for the fluid contained in the distribution ducts 237.

This balancing that is directly proportional to the pressures of said fluid is, in addition, achieved automatically.

Figure 13:
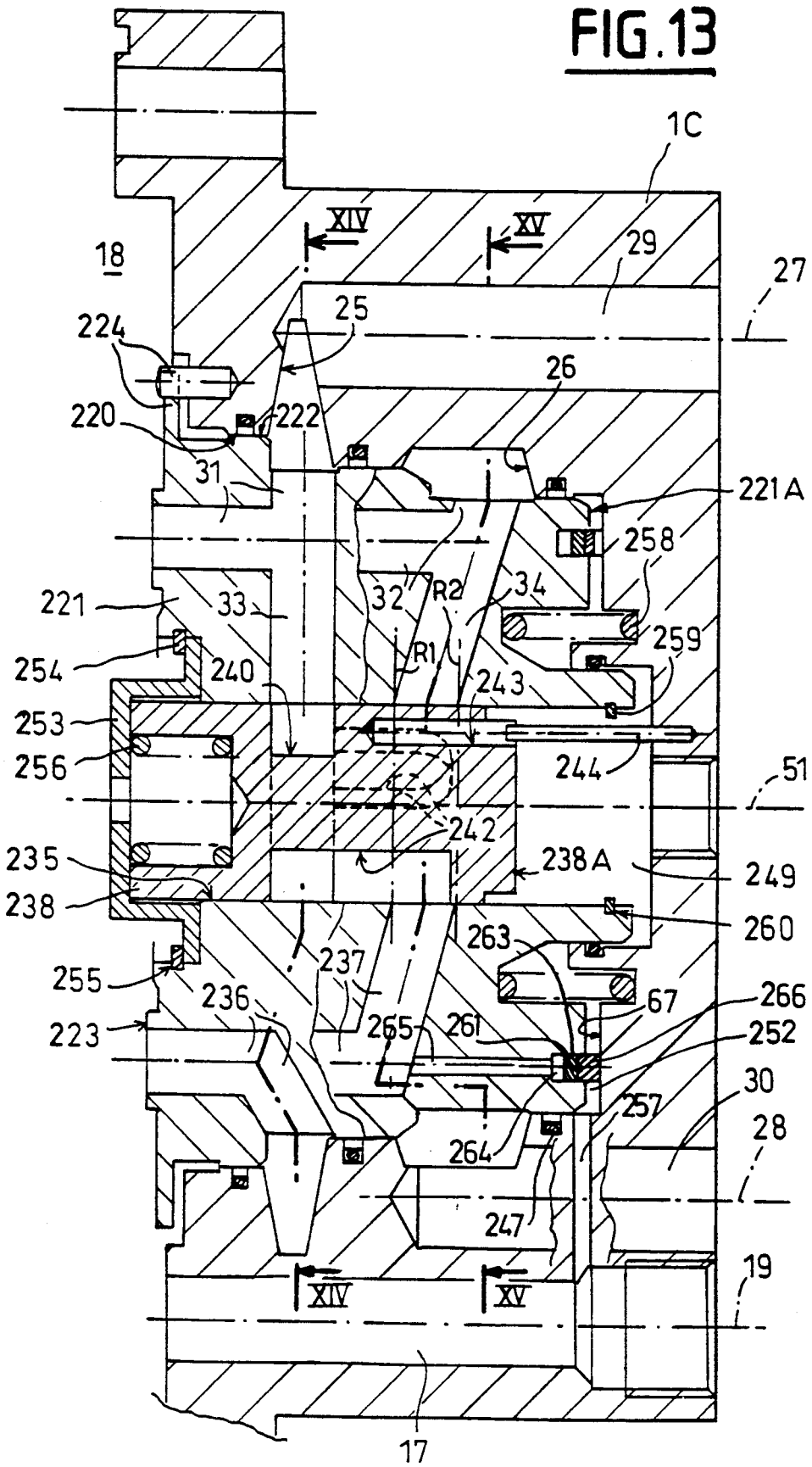
FIG. 13 is an axial section of the motor of FIG. 10 shown in a second operating configuration.
Figure 15:
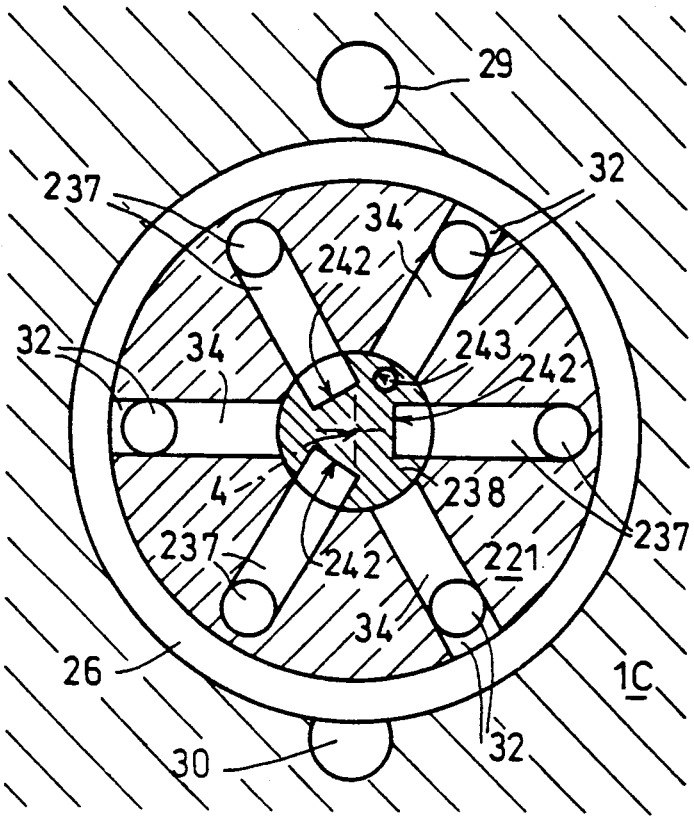
FIGS. 14 and 15 are sections, respectively on XIV—XIV and on XV—XV of the motor shown in FIG. 13.
Figure 14:
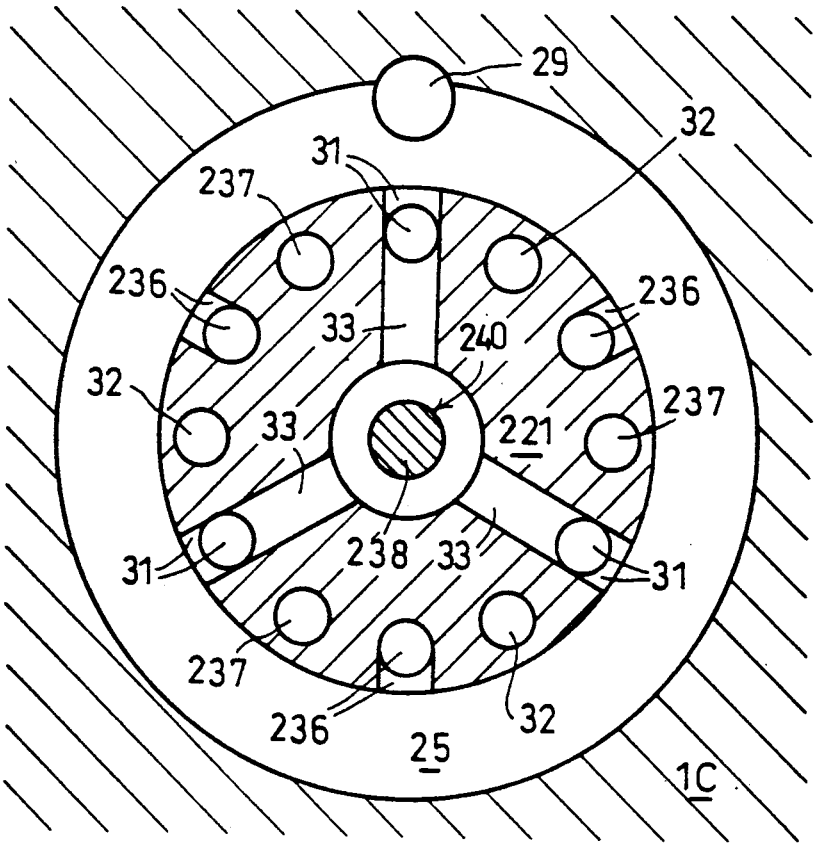

Assuming that the main fluid distributor 74 remains in its first position while the second fluid distributor 76 is placed in its second position, then the configuration of FIGS. 13 to 15 is obtained.

In this configuration, the ducts 237 are no longer connected to the main enclosure 26. Only those fluid working chambers 12 that correspond to rollers 14 pressing against the undulations corresponding to the ducts 31 and 32 are periodically fed with fluid under pressure and put into communication with the tank 72. The resulting cylinder capacity constitutes the small cylinder capacity of the motor.

The ducts 237 connected to the groove 240 by the blind ducts 242 which retain their constant angular orientation by virtue of the positioning obtained by the combined effect of the pin 244 and its housing 243, are put into communication with the main enclosure 25 by means of the ducts 33 and 31, as are, already, the ducts 236. The ducts 237 and 236 are thus in communication with the same main enclosure 25.

It should also be observed that the thrust of the fluid contained in said ducts 237 is, here again, automatically balanced by the actuator 263-266-261. Naturally, the shapes of the main enclosures 25 and 26 continue to ensure automatic balancing of the thrust between the ducts 31, 236 and the duct 32.

The motor shown in FIGS. 16 to 18 has no cylinder capacity selecting slide 38 and it therefore only has one cylinder capacity. This motor is derived from the motor of FIGS. 1 to 9 by using the same major and heavy parts, namely the case 1A-1B-1C, the cylinder block 7, etc. . . . , while adopting a new internal distributor 121 for fluid under pressure, which distributor is a part that is lighter than the others. In this internal fluid distributor 121, fluid thrust are balanced in a manner analogous to that obtained in the embodiment of FIGS. 1 to 9:

the thrust from fluid contained in the ducts 31 and 32 is automatically balanced by suitably selected shapes for the main enclosures 25 and 26; and the thrust from fluids contained in the ducts 136 and 137 is automatically balanced by means of balancing actuators 171-170-162, and 163-166-161.

Naturally, it would also be possible to design a variant of the motor shown in FIGS. 16 to 18 in which the hydrostatic thrust of the fluid contained either throughout the ducts 31 and 136, or else throughout the ducts 32 and 137 is balanced by an appropriate shape for the corresponding main enclosure 25 or 26, while the hydrostatic thrust from the fluid contained either in the ducts 137 or else in the ducts 136 is not balanced by the shape of the corresponding enclosure. Under such circumstances, instead of providing two complementary balancing enclosures (chambers 164 and 168), only one such enclosure need be provided to achieve balancing of the unbalanced portion of the hydrostatic thrust by means of the shape chosen for the corresponding main enclosure 25 or 26.

Whether they have a single cylinder capacity or a plurality of operating cylinder capacities, mechanisms of the invention always make it possible to obtain balanced operation of the internal fluid distributor without there being any need in a manufacturing range to modify the larger and more expensive parts of said mechanisms.

In addition, in a mechanism with a plurality of operating cylinder capacities there are only two main enclosures 25 and 26, thereby providing excellent axial compactness, with balancing remaining possible by virtue of the small auxiliary actuators 71-70-62, 63-66-61; 236-266-261; 171-170-162, 163-166-161.

A particularly advantageous important disposition should also be observed: in each of the embodiments shown, the chambers 64, 68, or 264 or 164, 168 are blind chambers which are connected by the ducts 65, 69, or 265, or 165, 169 in parallel with the ducts 36, 36 or 237, or 137, 136, respectively, so they do not have the flow conveyed by said ducts passing through them. These flows are large: if said chambers were required to convey said flows, they would necessarily have had to be large in section. This does not apply in the embodiments described and shown where said chambers can be small in size while, naturally, still ensuring that the function of balancing the internal fluid distributor is achieved, since they participate in said function.

The invention is not limited to the embodiments shown, but on the contrary covers any variant that could be applied thereto without going beyond their ambit or their spirit.

I claim:

1. A pressure fluid mechanism such as a hydraulic motor or a hydraulic pump, the mechanism comprising:

a reaction cam;

a cylinder block mounted to rotate relative to said reaction cam about an axis of rotation and provided with a planar communication face perpendicular to said axis of rotation;

a plurality of cylinders formed in the cylinder block;

a plurality of pistons slidably mounted in said cylinders, at least one piston per cylinder and delimiting within each cylinder a fluid working chamber which communicates with said communication face via a cylinder duct;

at least two main fluid enclosures suitable for containing a feed fluid for the working chambers and an exhaust fluid from said working chambers;

an internal fluid distributor which is prevented from rotating about said axis of rotation relative to said reaction cam, and including a distribution face which is a plane, perpendicular to said axis of rotation, and suitable for bearing in substantially fluid-tight manner against said communication face, and into which there open out distribution ducts suitable for being connected, some to one of said main enclosures and the others to the other one of said main enclosures; and balancing enclosures of the internal fluid distributor each communicating with some of said distribution ducts;

wherein the internal fluid distributor is delimited opposite from said distribution face by a transverse end face which is disposed facing a reaction face belonging to one of the two parts constituted by the cylinder block and by a structure secured to the reaction cam, while at least one of said balancing enclosures is constituted by a groove formed in the internal fluid distributor, said groove having cylindrical walls with an axis parallel to said axis of rotation, and opening out into said transverse end face, and by a sealing device which is received partially inside said groove and which bears for reaction purposes against said reaction face; said mechanism including:

distribution ducts formed in the internal fluid distributor, which are split up into a first group of pairs of distribution ducts and a second group of pairs of distribution ducts, with each pair comprising a first distribution duct and a second distribution duct, whereas the shapes of the walls delimiting the main enclosures also provide the balancing of the pressure forces of the fluid contained in the first and second distribution ducts of the first group of pairs of distribution ducts, respectively, said two main enclosures also constituting two first balancing enclosures; and at least one second balancing enclosure which is constituted by one of said grooves formed in the interval fluid distributor and opening out into its transverse end face and by said sealing device partially received in said groove, and which is connected by at least one duct formed in the internal fluid distributor to one of two sets of distribution ducts comprising a first set of the first distribution ducts of the second group of pairs of distribution ducts, and a second set of the second distribution ducts of said second group of pairs of distribution ducts.

2. The mechanism according to claim 1, wherein said groove is an annular groove.

3. The mechanism according to claim 1, wherein said groove is a blind groove and is connected in parallel with some of said distribution ducts, communicating only with said distribution ducts, without conveying the flow of fluid that may be conveyed by said distribution ducts.

4. A mechanism according to claim 1, wherein said reaction face is plane and perpendicular to said axis of rotation.

5. A mechanism according to claim 1, wherein the portion of said transverse end face into which said balancing enclosure opens out is plane and perpendicular to said axis of rotation.

6. The mechanism according to claim 1, wherein said mechanism is of the type including at least one large and at least one small operating cylinder capacity, and including:

the said two main enclosures one of which is suitable for containing the feed fluid and the other the exhaust fluid, when the mechanism is operating with each of said two operating cylinder capacities, the shapes of the walls delimiting said main enclosures also providing balancing of the pressure forces of the fluid contained in the distribution ducts which are permanently in communication with said main enclosures; and two secondary enclosures one of which contains the feed fluid and the other of which contains the exhaust fluid when the mechanism is operating with said large operating cylinder capacity, and which communicate with each other when the mechanism is operating with said small operating cylinder capacity; and wherein the two said secondary enclosures are each associated respectively with one of two second balancing enclosures, each being connected via at least one internal duct formed through the internal fluid distributor to one of said secondary enclosures.

7. The mechanism according to claim 1, wherein the mechanism is of the type including at least one large and at least one small operating cylinder capacity, the mechanism including:

said two main enclosures one of which is suitable for containing the feed fluid and the other the exhaust fluid, when the mechanism is operating at each of said two operating cylinder capacities, the shapes of the walls delimiting said main enclosures further providing balancing of the pressure forces contained in the distribution ducts which are permanently in communication with said main enclosures; and a single secondary enclosure which contains one of the exhaust and feed fluids when the mechanism is operating with said large operating cylinder capacity and which contains the other one of said fluids when the mechanism is operating with said small operating cylinder capacity; and wherein said single secondary enclosure is associated with a single one of said second balancing enclosures connected via at least one internal duct passing through the internal fluid distributor to said single secondary enclosure.

8. The mechanism according to claim 1, of the type having a single operating cylinder capacity and including:

the two main enclosures, one being suitable for containing the feed fluid and the other the exhaust fluid; and two said second balancing enclosures, one of which is connected via said internal ducts formed through the internal fluid distribution to the first distribution ducts of the second group of pairs of distribution ducts, the other one of which is connected via said internal ducts formed through the internal fluid distributor to the second distribution ducts of said second group of pairs of distribution ducts.

9. A pressure fluid mechanism such as a hydraulic motor or a hydraulic pump, the mechanism comprising:

a reaction cam;

a cylinder block mounted to rotate relative to said reaction cam about an axis of rotation and provided with a planar communication face perpendicular to said axis of rotation;

a plurality of cylinders formed in the cylinder block;

a plurality of pistons slidably mounted in said cylinders, at least one piston per cylinder and delimiting within each cylinder a fluid working chamber which communicates with said communication face via a cylinder duct;

at least two main fluid enclosures suitable for containing a feed fluid for the working chambers and an exhaust fluid from said working chambers;

an internal fluid distributor which is prevented from rotating about said axis of rotation relative to said reaction cam, and including a distribution face which is a plane, perpendicular to said axis of rotation, and suitable for bearing in substantially fluid-tight manner against said communication face, and into which there open out distribution ducts suitable for being connected, some to one of said main enclosures and the others to the other one of said main enclosures; and balancing enclosures of the internal fluid distributor each communicating with some of said distribution ducts;

wherein the internal fluid distributor is delimited opposite from said distribution face by a transverse end face which is disposed facing a reaction face belonging to one of the two parts constituted by the cylinder block and by a structure secured to the reaction cam, while at least one of said balancing enclosures is constituted by a groove formed in the internal fluid distributor, said groove having cylindrical walls with axis parallel to said axis of rotation and opening out into said transverse end face and by a sealing device which is received partially inside said groove and which bears for reaction purposes against said reaction face; and, wherein said groove is a blind groove and is connected in parallel with some of said distribution ducts, communicating only with said distribution ducts without conveying the flow of fluid that may be conveyed by said distribution ducts;

said mechanism including:

distribution ducts formed in the internal fluid distributor, which are split up into first and second groups of pairs of distribution ducts, each pair comprising a first distribution duct and a second distribution duct, whereas the shapes of the walls delimiting the main enclosures also provide the balancing of the pressure forces of the fluids contained in the first and second distribution ducts of the first group of pairs of distribution ducts, respectively, said two main enclosures also constituting two first balancing enclosures; and at least one second balancing enclosure constituted by one of said grooves formed in the internal fluid distributor and opening out into its transverse end face and by one of said sealing devices partially received in said groove, and which is connected by at least one duct formed in the internal fluid distributor to one of the two sets of distribution ducts comprising a first set of the first distribution ducts of the second group of pairs of distribution ducts, and a second set of the second distribution ducts of said second group of pairs of distribution ducts.

10. The mechanism according to claim 9, wherein the mechanism is of the type including at least one large and at least one small operating cylinder capacity, the mechanism including:

said two main enclosures one of which is suitable for containing the feed fluid and the other the exhaust fluid, when the mechanism is operating at each of said two operating cylinder capacities, the shapes of the walls delimiting said main enclosures further providing balancing of the pressure forces contained in the distribution ducts which are permanently in communication with said main enclosures; and a single secondary enclosure which contains one of the exhaust and feed fluids when the mechanism is operating with said large operating cylinder capacity and which contains the other one of said fluids when the mechanism is operating with said small operating cylinder capacity; and wherein said single secondary enclosure is associated with a single one of said second balancing enclosures connected via at least one internal duct passing through the internal fluid distributor to said single secondary enclosure.

11. A mechanism according to claim 9, of the type having a single operating cylinder capacity and including:

the two main enclosures one suitable for containing the feed fluid and the other the exhaust fluid; and two said two second balancing enclosures one of which is connected via said internal ducts formed through the internal fluid distribution to the first distribution ducts of the second group of pairs of distribution ducts, the other one of which is connected via said internal ducts formed through the internal fluid distributor to the second distribution ducts of said second group of pairs of distribution ducts.

12. The mechanism according to claim, 9, wherein said mechanism is of the type including at least one large and at least one small operating cylindrical capacity, and including:

the said two main enclosures one of which is suitable for containing the feed fluid and the other the exhaust fluid, when the mechanism is operating with each of said two operating cylinder capacities, the shapes of the walls delimiting said main enclosures also providing balancing of the pressure forces of the fluid contained in the distribution ducts which are permanently in communication with said main enclosures; and two secondary enclosures one of which contains the feed fluid and the other of which contains the exhaust fluid when the mechanism is operating with said large operating cylinder capacity, and which communicate with each other when the mechanism is operating with said small operating cylinder capacity; and wherein the two said secondary enclosures are associated respectively with one of two second balancing enclosures, each being connected via at least one internal duct formed through the internal fluid distributor to one of said secondary enclosures.

13. The mechanism according to claim 12, wherein said groove is an annular groove.

* * * * *